United States Patent [19]

Lary

[11] 4,172,373

[45] Oct. 30, 1979

[54] PAINT ROLLER WASHER

[76] Inventor: Banning K. Lary, 5942 SW. 61st St., Miami, Fla. 33143

[21] Appl. No.: 889,062

[22] Filed: Mar. 22, 1978

[51] Int. Cl.[2] ..... B08B 3/02; B08B 9/00; B08B 11/02; D06B 5/24

[52] U.S. Cl. ..... 68/213; 134/166 R; 134/198; 137/592; 239/273

[58] Field of Search ..... 134/44, 138–139, 134/149, 166 R, 166 C–168 R, 168 C, 172, 198, 201, 22 R, 22 C; 68/189, 198, 213; 239/273, 279–280; 137/592

[56] References Cited

U.S. PATENT DOCUMENTS

| | | | |
|---|---|---|---|
| 149,402 | 4/1874 | Hupfel | 134/44 |
| 243,501 | 6/1881 | Brown | 137/592 X |
| 2,217,212 | 10/1940 | Brandwood | 68/198 X |
| 2,713,868 | 7/1955 | Lewis | 134/172 |
| 3,421,527 | 1/1969 | Dettman | 134/149 X |
| 3,428,060 | 2/1969 | Spivey | 134/149 X |
| 3,944,138 | 3/1976 | Easton | 239/273 X |

FOREIGN PATENT DOCUMENTS

| | | | |
|---|---|---|---|
| 556428 | 8/1932 | Fed. Rep. of Germany | 134/166 R |

*Primary Examiner*—Robert L. Bleutge
*Attorney, Agent, or Firm*—Ernest H. Schmidt

[57] ABSTRACT

A device for flush washing water base paint from paint rollers has an upstanding tubular member adapted to telescopingly receive, in surrounding relation, a paint roller to be washed. A water supply nipple communicating with a lower end portion of the tubular member connects with a source of running water which flows upwardly through the tubular member and its supported roller so as to cascade circumferentially about and through the outer nap thereof for flushing away water base paint. An increased-diameter peripheral shoulder near the lower end of the tubular member is provided with a sealing gasket against which the lower end of the paint roller seats while being washed.

5 Claims, 2 Drawing Figures

PAINT ROLLER WASHER

Figure 1:
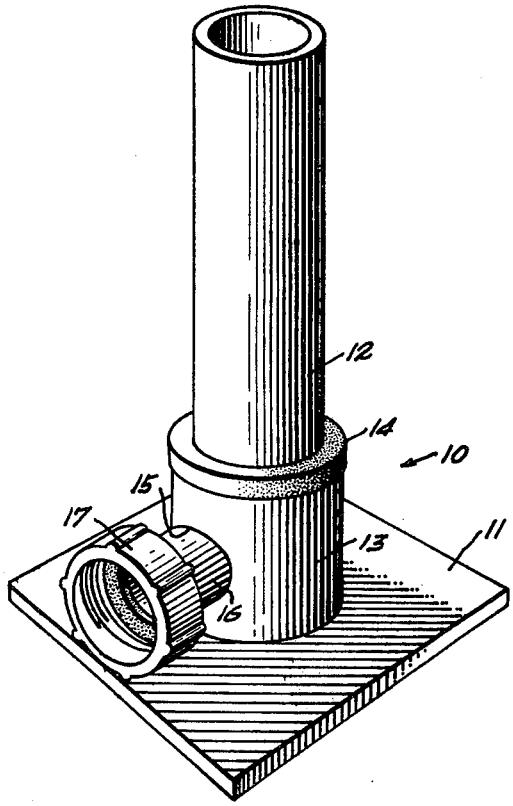

This invention relates to paint rollers and is directed particularly to a device for automatically washing paint rollers after painting with water base paints.

Because of the comparative rapidity with which the painting of flat wall surfaces and the like can be painted with the use of paint rollers, their use has become more and more widespread in recent years. This is especially true when painting with the widely used water base paint.

While water base paints are easily removed from painting implements during clean-up as compared with the removal of oil base paints, for example, the manual flush washing of paint rollers, particularly high quality paint rollers having a deep, thick pile, is a time consuming and messy chore. It is, accordingly, the principal object of my invention to provide a device for automatically flush-washing water base paint from paint rollers. A more particular object of the invention is to provide a water flush washer for paint rollers that can readily be connected to a garden hose or the like water source and which serves to flush wash a paint roller quickly and with efficient use of water.

Another object of my invention is to provide a paint roller cleaner of the character described which is readily adaptable to use in cleaning two or more paint rollers simultaneously.

Figure 2:
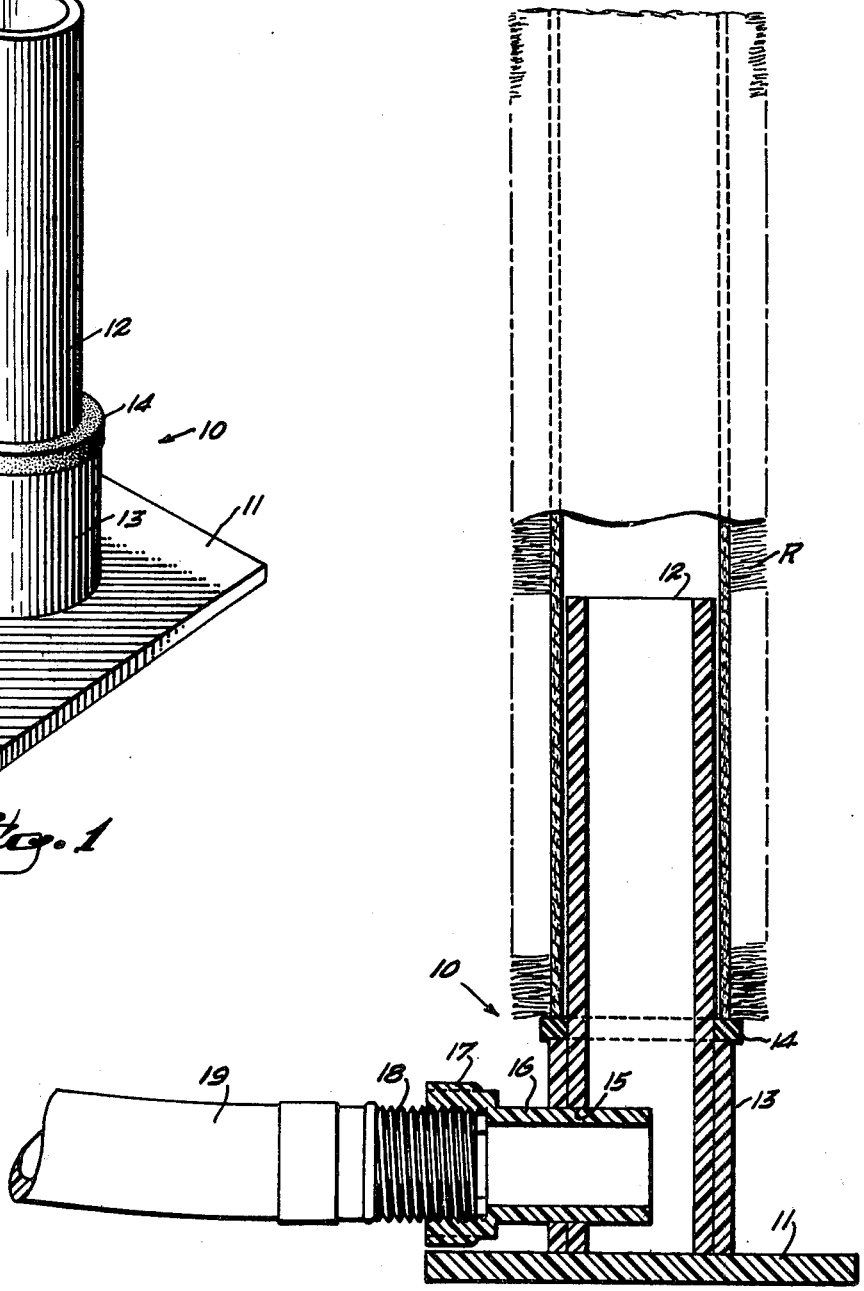

Another object of my invention is to provide a paint roller cleaner device of the above nature which will be simple in structure, easy to use, economical to manufacture, compact, durable in use, and dependable in operation. Other objects, features and advantages of my invention will be apparent from the following description when read with reference to the accompanying drawings. In the drawings, wherein like reference numerals denote corresponding parts in each of the two views:

FIG. 1 is a perspective view of a paint roller washer embodying the invention; and FIG. 2 is a longitudinal cross-sectional view thereof, with a paint roller fitted in place ready for washing. Referring now to the drawings in detail, reference numeral 10 designates, generally, a preferred form of paint roller washer embodying the invention, which can conveniently be fabricated of stock PVC plastic parts, for example, or integrally molded of a synthetic plastic material. In the embodiment illustrated, the paint roller washer is fabricated of cemented or otherwise secured together stock PVC sections or members, and comprises a square base member 11 centrally secured to the upper surface of which is an upstanding tubular member 12 closely fitted about which is a comparatively short, tubular sleeve 13, also secured, as by cementing, to the upstanding tubular member 12 and base 11. The upper end of the comparatively short sleeve 13 defines a peripheral shoulder about the upstanding tubular member 12, against which a rubber or Neoprene ring gasket 14 is seated. Slideably fitted and frictionally retained in a circular through opening 15 provided in side wall portions of tubular member 12 and tubular sleeve 13, is the tubular shank portion 16 comprising an integral part of an internally-threaded hose connector nipple 17.

In use, washing water is supplied to the device through an ordinary garden hose (partially illustrated in FIG. 2) threadingly interconnected to the nipple 17. It will be understood that the interconnection nipple 17 can readily be connected to or removed from the water supply hose by first separating it from the body of the device, the friction fit thereof, while being sufficient to retain it in place under all conditions of use, nevertheless allowing for its manual withdrawal.

As illustrated in FIG. 2, the roller R to be cleaned after painting will be fitted down over the upwardly projecting end portion of tubular member 12 to seat at its lower end against the gasket 14. In this connection it will be understood that the outer diameter of the tubular sleeve 13 is such as to provide for loose circumjacent fitting, with the fit being close enough to provide for the seating of the lower end of the core of an ordinary paint roller against the upper peripheral surface of the ring gasket 14.

To begin the automatic washing process, water is fed through hose 19 to the interior of the tubular member 12, whereupon it will rise to the upper end of the roller and cascade downwardly about the outer periphery thereof to continuously flush water base paint to be removed from the outer nap or pile of the roller. The rate of the water flow need only be great enough to provide for downward flow over the entire outer periphery of the roller. The continuous downward rush of water through the nap in this manner has been found to thoroughly clean a paint roller within a very few minutes, and can usually be completed during the time that the other painting implements such as the roller paint pan are being manually washed.

Although the illustrated embodiment of the invention is described in connection with the cleaning of a single paint roller, that is, one paint roller R at a time, it is contemplated also that the length of the tubular member 12 could be extended to accommodate two or more vertically stacked rollers for simultaneous cleaning. Alternatively, a removeable tubular extension could be provided for the member 12 to accommodate two or more rollers for simultaneous washing.

While I have illustrated and described only one form in which my invention can conveniently be embodied in practice, it is to be understood that this form is presented by way of example only and not in a limiting sense. My invention, in brief, comprises all the embodiments and modifications coming within the scope and spirit of the following claims.

What I claim as new and desire to secure by Letters Patent is:

1. An automatic paint roller washer comprising, in combination, a horizontal base, a tubular member secured with respect to and extending vertically upwardly of said base and terminating in an open end aperture, means for supplying running water to the interior of the lower end of said tubular member to provide for the flow of water outwardly of the upper end aperture thereof, and peripheral abutment means surrounding a lower end portion of said tubular member for the seating thereagainst of the lower end of a paint roller fitted over said tubular member for washing, said water supplying means comprising a circular opening in the side wall of said tubular member, and a tubular nipple shank of such diameter as to be friction-fit-received in said circular opening.

2. An automatic paint roller washer member as defined in claim 1 wherein the outer end of said tubular nipple shank is integrally formed with an internally-threaded hose connector portion.

3. An automatic paint roller washer member as defined in claim 2 wherein said peripheral abutment means comprises a ring gasket surrounding said tubular member.

4. An automatic paint roller washer member as defined in claim 3 including a comparatively short tubular sleeve surrounding the lower end portion of said tubular member and secured with respect thereto and to said base, said circular opening extending coaxially through said tubular member.

5. An automatic paint roller washer member as defined in claim 4 wherein said peripheral ring gasket is seated against the upper end of said tubular sleeve.

* * * * *